US010187714B2

(12) United States Patent
Takehisa et al.

(10) Patent No.: US 10,187,714 B2
(45) **Date of Patent: *Jan. 22, 2019**

(54) SOUND PICKUP DEVICE AND SOUND PROCESSING DEVICE

(71) Applicant: YAMAHA CORPORATION, Hamamatsu-shi (JP)

(72) Inventors: Hideaki Takehisa, Hamamatsu (JP); Nobuhiro Nambu, Hamamatsu (JP); Masamichi Yano, Hamamatsu (JP); Keizo Harada, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/490,243

(22) Filed: Apr. 18, 2017

(65) Prior Publication Data

US 2017/0311065 A1 Oct. 26, 2017

(30) Foreign Application Priority Data

Apr. 20, 2016 (JP) ..... 2016-084713

(51) Int. Cl.
*H04R 1/08* (2006.01)
*H04R 1/28* (2006.01)
(Continued)

(52) U.S. Cl.
CPC ..... *H04R 1/08* (2013.01); *G10H 3/146* (2013.01); *H04R 1/02* (2013.01); *H04R 1/04* (2013.01);
(Continued)

(58) Field of Classification Search
CPC ... H04R 1/08; H04R 1/02; H04R 1/04; H04R 1/2892; H04R 1/46; H04R 3/005;
(Continued)

(56) References Cited

U.S. PATENT DOCUMENTS 6,441,292 B1 8/2002 Donnell
9,466,277 B1 * 10/2016 Myers ..... G10H 3/14
(Continued)

FOREIGN PATENT DOCUMENTS

JP 2009094851 A 4/2009

OTHER PUBLICATIONS

Extended European Search Report issued in European Appln. No. 17166820.5 dated Aug. 7, 2017.
(Continued)

*Primary Examiner* — David Ton
(74) *Attorney, Agent, or Firm* — Rossi, Kimms & McDowell LLP

(57) ABSTRACT

A sound pickup device includes: a housing; a mount portion via which the housing on an object constituting a portion of a musical instrument; a sound pickup including a plurality of the microphones respectively oriented in different directions; a first output configured to output a sound signal indicating a sound input to the sound pickup; and an installer configured to install the sound pickup on the housing such that each of the plurality of microphones is oriented away from the object when the housing is mounted on the object via the mount portion.

16 Claims, 10 Drawing Sheets

(51) Int. Cl.

| | |
|---|---|
| ***H04R 1/46*** | (2006.01) |
| ***H04R 3/00*** | (2006.01) |
| ***H04R 29/00*** | (2006.01) |
| ***G10H 3/14*** | (2006.01) |
| ***H04R 1/02*** | (2006.01) |
| ***H04R 1/04*** | (2006.01) |
| *H04R 19/01* | (2006.01) |

(52) U.S. Cl.
CPC ..... *H04R 1/2892* (2013.01); *H04R 1/46* (2013.01); *H04R 3/005* (2013.01); *H04R 29/005* (2013.01); *G10H 2220/211* (2013.01); *G10H 2220/525* (2013.01); *G10H 2230/281* (2013.01); *H04R 19/016* (2013.01)

(58) Field of Classification Search
CPC .... H04R 29/005; H04R 19/016; G10H 3/146; G10H 2220/525
See application file for complete search history.

(56) References Cited

U.S. PATENT DOCUMENTS

| | | | | |
|---|---|---|---|---|
| 9,848,256 | B2 * | 12/2017 | Murata | H04R 1/08 |
| 2005/0257671 | A1 * | 11/2005 | Aimi | G10H 3/146 84/735 |
| 2008/0310649 | A1 | 12/2008 | Yamada | |
| 2009/0007763 | A1 * | 1/2009 | Steele | G10H 3/146 84/746 |
| 2010/0031806 | A1 * | 2/2010 | Gaynier | G10H 3/22 84/723 |
| 2014/0301589 | A1 | 10/2014 | Greenwood et al. | |
| 2016/0037246 | A1 * | 2/2016 | Murata | H04R 1/08 381/361 |
| 2016/0093278 | A1 | 3/2016 | Esparza | |
| 2017/0311066 | A1 | 10/2017 | Takehisa et al. | |

OTHER PUBLICATIONS

Extended European Search Report issued in European Appln. No. 17166822.1 dated Aug. 18, 2017.
Office Action issued in U.S. Appl. No. 15/490,509 dated Feb. 9, 2018.
Notice of Allowance issued in U.S. Appl. No. 15/490,509, dated Jul. 17, 2018.
Office Action issued in European Appln. No. 17166820.5 dated Jul. 17, 2018.
Office Action issued in European Appln. No. 17166822.1 dated Jul. 17, 2018.
Bibster. "Forum: Remote Possibilities in Acoustic Music and Location Recording: Zoom H4n." www.gearslutz.com. Aug. 29, 2011: 1-2. Web. Jul. 11, 2018. Cited in NPL 1.
Johnsantic. "Zoom Gear & Home Recording Forum, Disassembling the Zoom H4n (with pics)" www.zoomforum.us. May 9, 2010: 1-9. Web. Jul. 10, 2018. Cited in NPL 1.
"H04next Handy Recorded Operation Manual." Jul. 23, 2015: p. 14. Zoom Corporation. www.zoom-na.com. Web. Jul. 10, 2018. Cited in NPL 1.
Notice of Allowance issued in U.S. Appl. No. 15/490,509 dated Sep. 5, 2018.

* cited by examiner

SOUND PICKUP DEVICE AND SOUND PROCESSING DEVICE

CROSS REFERENCE TO RELATED APPLICATION

The present application claims priority from Japanese Patent Application No. 2016-084713, which was filed on Apr. 20, 2016, the disclosure of which is herein incorporated by reference in its entirety.

BACKGROUND

The following disclosure relates to a technique of picking up a sound produced by a musical instrument.

Performance sounds (playing sounds) produced by a drum set are usually obtained using a plurality of microphones. In many cases, the microphones are arranged so as to surround the drum set or arranged near striking surfaces of a snare drum, a tom, a floor tom, and a bass drum. In the case where the microphones are arranged near the striking surfaces, holders for supporting the microphones are attached to a component different from the striking surface (a head) such as a shell or a rim of the drum, for example. Each microphone supported by the holder is adjusted by a person having installed the microphone, so as to be oriented toward the striking surface. Patent Document 1 (Japanese Patent Application Publication No. 2009-094851) discloses such holders, for example.

SUMMARY

Installation of a plurality of microphones is not enough to pick up high-quality performance sounds produced by a drum set. Sound recording with high quality requires the microphones to be placed at appropriately adjusted positions and orientations, but appropriate placement of the microphones requires a high degree of knowledge and experience. Also, not only the microphones but also equipment for installing the microphones is required, leading to a lot of pieces of equipment. Thus, much time is required for setting a system for picking up sounds. Moreover, portability of the system is not good.

Accordingly, an aspect of the disclosure relates to easy installation of a device for obtaining performance sounds produced by a musical instrument, with appropriate localization.

In one aspect of the disclosure, a sound pickup device includes: a housing; a mount portion via which the housing on an object constituting a portion of a musical instrument; a sound pickup including a plurality of the microphones respectively oriented in different directions; a first output configured to output a sound signal indicating a sound input to the sound pickup; and an installer configured to install the sound pickup on the housing such that each of the plurality of microphones is oriented away from the object when the housing is mounted on the object via the mount portion.

In another aspect of the disclosure, a sound processing device includes: the sound pickup device; a sound processor configured to add a sound effect to the sound signal output from the first output; and a third output configured to output a sound signal to which the sound effect is added.

In yet another aspect of the disclosure, a sound processing device includes: the sound pickup device; a sound processor configured to add a sound effect to the sound signal output from the first output; a sound-signal producer configured to produce a sound signal based on the vibration signal output from the second output; and a third output configured to synthesize the sound signal to which the sound effect is added by the sound processor, with one of the sound signal produced by the sound-signal producer and a sound signal produced by adding a sound effect to the sound signal produced by the sound-signal producer, the third output being configured to output the synthesized sound signal.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Figure 1:
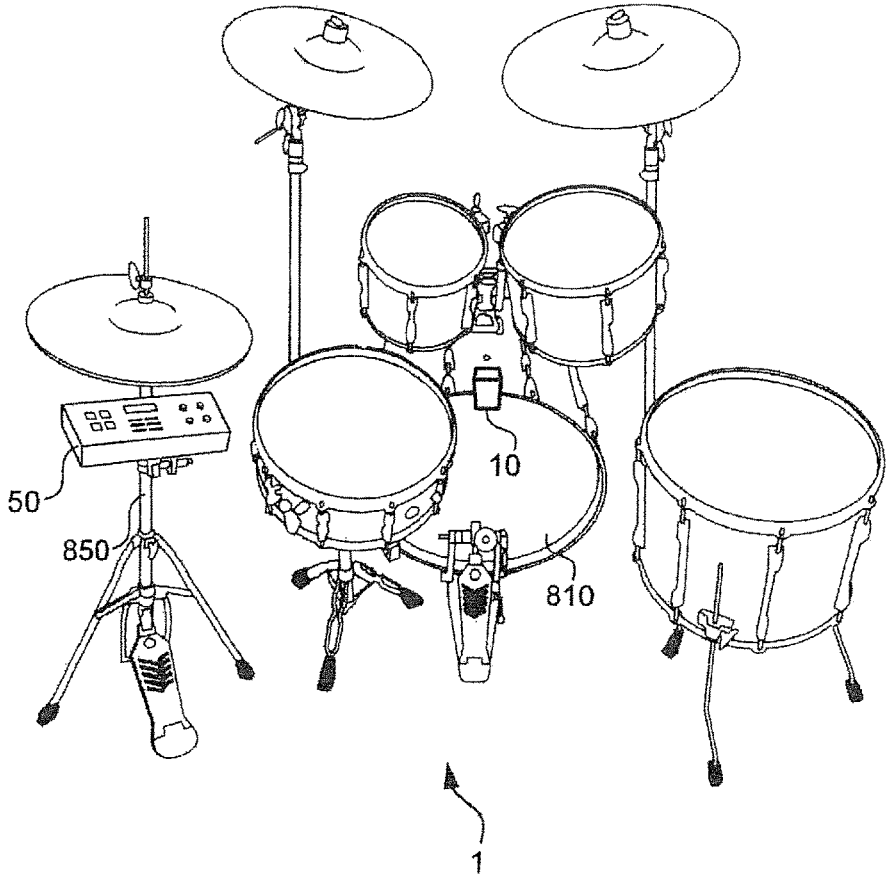
FIG. 1 is a view for explaining a position at which a sound processing device according to a first embodiment is installed on a drum set.

Hereinafter, there will be described embodiments by reference to the drawings. It is to be understood that the following embodiments are described only by way of example, and the disclosure may be otherwise embodied with various modifications without departing from the scope and spirit of the disclosure. It is noted that the same reference numerals or similar reference numerals (with a letter such as "A" or "B" added to the end of the number) are used to designate the same components or components having a similar function, and an explanation of which is dispensed with. In some figures, a ratio of dimensions (such as a ratio between components and a ratio of a height, a width, and a depth) differs from an actual ratio, and portions of some components are omitted for easier understanding.

First Embodiment

Overview of Sound Processing Device

There will be described an overview of a sound processing device according to a first embodiment. In this example, the sound processing device is used in a state in which the sound processing device is mounted on a drum set. The sound processing device is capable of obtaining a performance sound (playing sound) produced from the drum set and outputting a sound signal. Predetermined sound effects may be added to the sound signal.

FIG. 1 is a view for explaining a position at which the sound processing device according to the first embodiment is installed on the drum set. A sound processing device 1 according to the first embodiment includes a sound pickup device 10 and a controller 50. The sound pickup device 10 is removably fastened to a bass drum 810.

Figure 2:
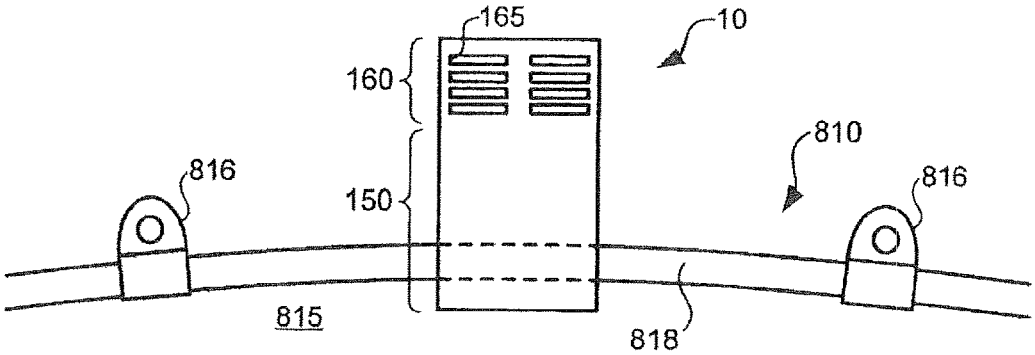
FIG. 2 is a view for explaining a position at which a sound pickup device according to the first embodiment is disposed.

FIG. 2 is a view for explaining a position at which the sound pickup device according to the first embodiment is disposed. FIG. 2 is a view of the sound pickup device 10 viewed from a front side of the sound pickup device 10. In the following explanation, a front surface of the sound pickup device 10 faces a player of the drum set in the case where the sound pickup device 10 is installed on the drum set as follows (in the case where the sound pickup device 10 is fastened to an upper portion of the bass drum 810). Upper, lower, back, and side surfaces of the sound pickup device 10 are defined with reference to the front surface of the sound pickup device 10. Also, upper, lower, right, and left sides are defined with reference to a state in which the sound pickup device 10 installed on the drum set is viewed from the front side. The sound pickup device 10 is installed on a central portion of the upper portion of the bass drum 810. In this example, the sound pickup device 10 is installed between lugs 816 located adjacent to each other, so as to hold a shell 818. A specific configuration will be described below.

A housing 150 and a microphone cover 160 are disposed on a front portion of the sound pickup device 10. The housing 150 and the microphone cover 160 are formed of a material capable of protecting components provided in the sound pickup device 10 if the sound pickup device 10 is struck by the player by mistake. For example, the housing 150 and the microphone cover 160 are formed of metal such as stainless steel. The housing 150 and the microphone cover 160 are formed integrally with each other in this example but may be formed independently of each other. Alternatively, the sound pickup device 10 may be configured such that the microphone cover 160 is formed integrally with a sound pickup portion 110, and a component constituted by the sound pickup portion 110 and the microphone cover 160 is mounted on the housing 150. The microphone cover 160 is located on an opposite side of the shell 818 from a head of the bass drum 810 (hereinafter may be referred to as "striking surface 815"). The microphone cover 160 has an opening 165 through which a sound pass.

Returning to FIG. 1, the sound pickup device 10 obtains a performance sound emitted from the drum set, by picking up the sound at a position at which the sound pickup device 10 is installed. The sound pickup device 10 outputs a sound signal based on the obtained performance sound. The sound pickup device 10 obtains a vibration of the bass drum 810 and outputs a vibration signal based on the obtained vibration.

In this example, the controller 50 is installed on a stand 850 for a high-hat cymbal. The controller 50 creates a sound signal and adds a sound effect to the sound signal based on the input signal. In this example, the controller 50 creates a sound signal based on the vibration signal output from the sound pickup device 10. The controller 50 adds a sound effect to the created sound signal and the sound signal output from the sound pickup device 10, to output a sound signal. Sounds are emitted by a sound emitter, such as headphones, based on the sound signals output from the controller 50. As a result, the player listens to sounds based on playing of the drum set.

It is noted that the sound pickup device 10 and the controller 50 are connected to each other by, e.g., a cable in this example but may be connected to each other wirelessly. Also, the controller 50 and the sound emitter may be connected to each other by, e.g., a cable or wirelessly.

There will be next described functional configurations of the sound pickup device 10 and the controller 50. A specific construction of the sound pickup device 10 will be described after description of the functional configuration.

Functional Configuration of Sound Pickup Device

Figure 3:
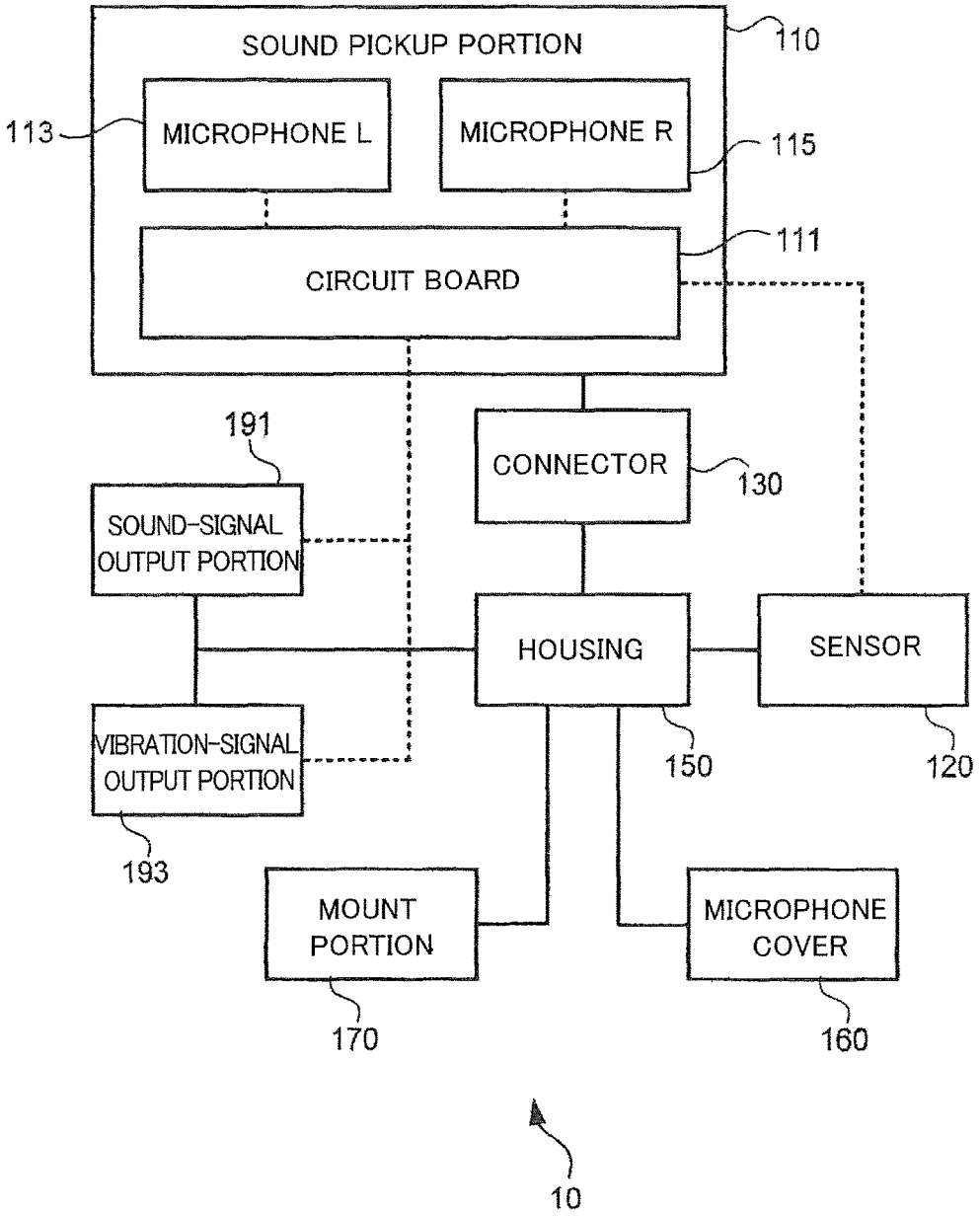
FIG. 3 is a block diagram illustrating a configuration of the sound pickup device according to the first embodiment.

FIG. 3 is a block diagram illustrating a configuration of the sound pickup device according to the first embodiment. In this block diagram, the solid lines connecting the blocks indicate a physical connection relationship, and the broken lines connecting the blocks indicate an electric connection relationship. The sound pickup device 10 includes the sound pickup portion 110, a sensor 120, a connector 130 as one example of an installer, the housing 150, the microphone cover 160, a mount portion 170, a sound-signal output portion 191 as one example of a first output, and a vibration-signal output portion 193 as one example of a second output.

The sound pickup portion 110 includes a circuit board 111, a microphone L113 for a left channel, and a microphone R115 for a right channel. Each of the microphone L113 and the microphone R115 has a directivity and converts an input sound to an electric signal to output the converted signal. The circuit board 111 includes an amplifier circuit configured to amplify signals output from the microphone L113 and the microphone R115 and configured to output the amplified signals to the sound-signal output portion 191 as sound signals (stereo two-channel signals). In this example, each of the microphone L113 and the microphone R115 is an electret condenser microphone (ECM). Thus, the circuit board 111 includes a power supply circuit configured to receive electric power supplied from an external device via the sound-signal output portion 191 and supply the electric power to the microphone L113 and the microphone R115. It is noted that this electric power may be supplied from a battery, for example.

The sensor 120 is a vibration sensor constituted by an piezoelectric element, for example. The sensor 120 is connected to the housing 150. The sensor 120 receives vibration transmitted to the housing 150 and outputs a signal indicating the vibration. It is noted that when the striking surface 815 of the bass drum 810 on which the sound pickup device 10 is installed is struck and vibrated, the vibration is transmitted to the housing 150 via the mount portion 170. The sensor 120 detects the vibration transmitted to the housing 150 in this manner.

In this example, the circuit board 111 includes an amplifier circuit configured to amplify a signal output from the sensor 120 and outputs the amplified signal to the vibration-signal output portion 193 as a vibration signal. It is noted that while the circuit board 111 of the sound pickup portion 110 includes this amplifier circuit in this example, another circuit board may include the amplifier circuit. In this case, the circuit board configured to process the signal output from the sensor 120 at least needs to be connected to the housing 150 and need not be connected to the housing 150 via the connector 130 as will be described below.

The microphone cover 160 is connected to the housing 150 and covers at least portions of the microphone L113 and the microphone R115. As described above, the microphone cover 160 is disposed on a player-side (front side) and right and left sides of the microphone L113 and the microphone R115 in the state in which the sound pickup device 10 is installed on the bass drum 810. It is noted that the microphone cover 160 may be located also on another or other sides of the microphone L113 and the microphone R115 (e.g., on a back side and/or an upper side).

The mount portion 170 is connected to the housing 150 and has a structure for mounting the sound pickup device 10 onto the shell 818 of the bass drum 810. As will be described below in detail, in this example, the mount portion 170 pinches the plate-like shell 818 having a cylindrical region to mount the housing 150 onto the shell 818 so as to fix their positional relationship. Each of the microphone L113 and the microphone R115 is oriented in a direction that intersects a direction in which the housing 150 is mounted, i.e., a direction in which a cylinder of the cylindrical shape extends.

The sound-signal output portion 191 is a terminal connected to the housing 150. An external device is connected to the sound-signal output portion 191 by a cable, for example. The sound signal output from the circuit board 111 is supplied to the external device connected to the sound-signal output portion 191 (the controller 50 in this example). The vibration-signal output portion 193 is a terminal connected to the housing 150. An external device is connected to the vibration-signal output portion 193 by a cable, for example. The vibration signal output from the circuit board 111 is supplied to the external device connected to the vibration-signal output portion 193 (the controller 50 in this example).

The connector 130 connects the housing 150 and the sound pickup portion 110 to each other. In this example, the connector 130 includes an absorber that absorbs a vibration transmitted between the housing 150 and the sound pickup portion 110. The absorber is formed of a cushioning material such as rubber, for example. This absorber makes it difficult for the vibration transmitted to the housing 150 to reach the sound pickup portion 110. As a result, minimized amount of the vibration transmitted to the housing 150 (e.g., vibration caused by strike of the striking surface 815 of the bass drum 810) is transmitted to the microphone L113 and the microphone R115 of the sound pickup portion 110 and converted into an electric signal.

Functional Configuration of Controller

Figure 4:
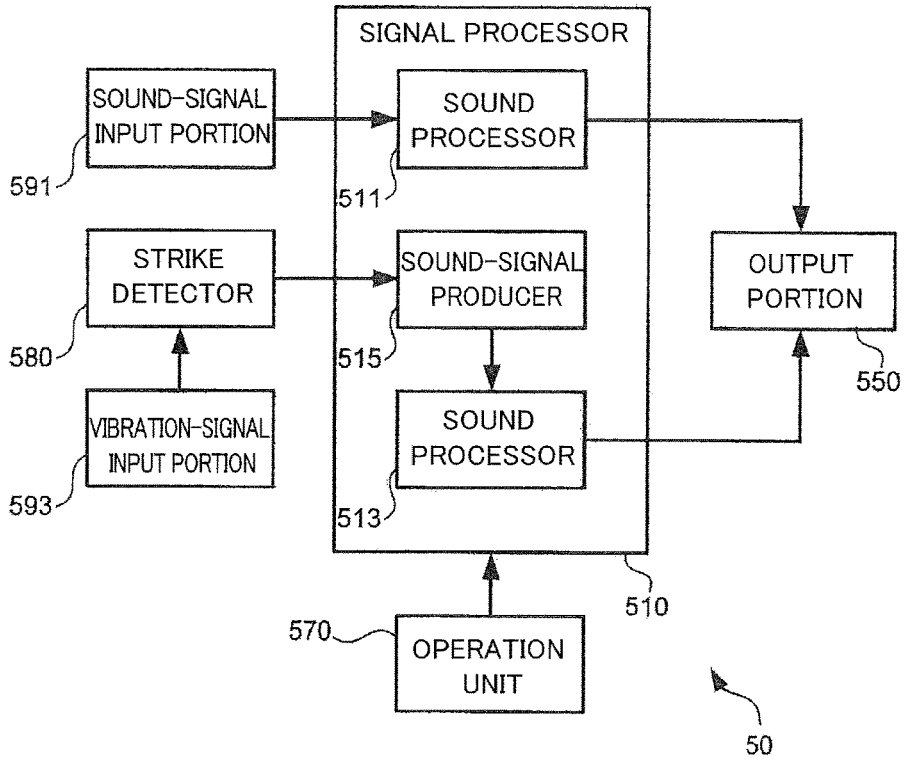
FIG. 4 is a block diagram illustrating a controller in the first embodiment.

FIG. 4 is a block diagram illustrating the controller in the first embodiment. The controller 50 includes a signal processor 510, an output portion 550 as one example of a third output, an operation unit 570, a strike detector 580, a sound-signal input portion 591, and a vibration-signal input portion 593.

The sound-signal input portion 591 is a terminal to which an external device is connected by a cable, for example. In this example, the sound pickup device 10 is connected to the sound-signal input portion 591, and the sound signal output from the sound pickup device 10 is input to the sound-signal input portion 591. The sound-signal input portion 591 is configured to output the input sound signal to the signal processor 510. The vibration-signal input portion 593 is a terminal to which an external device is connected by a cable, for example. In this example, the sound pickup device 10 is connected to the vibration-signal input portion 593, and the vibration signal output from the sound pickup device 10 is input to the vibration-signal input portion 593. The vibration-signal input portion 593 is configured to output the input vibration signal to the strike detector 580.

The strike detector 580 is configured to detect a timing and a strength of strike of the striking surface 815 of the bass drum 810, based on a vibration waveform indicated by the vibration signal. One example of the timing of strike is a timing at which the amplitude of the vibration waveform exceeds a predetermined threshold value. One example of the strength of strike is a peak value of the amplitude within a predetermined length of time from the timing at which the amplitude of the vibration waveform exceeds the predetermined threshold value. Upon detecting the timing of strike, the strike detector 580 detects the strength of strike and sends the signal processor 510 a strike signal indicating the strength. For example, the strike signal may be a MIDI signal. In this case, the strike signal contains Note-On information and a velocity.

The signal processor 510 includes sound processors 511, 513 and a sound-signal producer 515. The sound processor 511 is configured to add a sound effect (e.g., reverberation, delay, distortion, and compression) based on a set parameter to the sound signal input from the sound-signal input portion 591 and configured to output the sound signal with the sound effect. This parameter may be a predetermined value and may be a value input via the operation unit 570. It is noted that the operation unit 570 is a device configured to accept instructions input by a user. The operation unit 570 includes buttons, a knob, and a touch screen, for example. In the case where a plurality of parameters are set, combinations of values for the parameters may be stored in advance as templates for enabling the user to select a template to be used by operating the knob, for example. It is noted that the operation unit 570 may be an external device connected to the controller 50. Examples of the external device include a pad and a foot switch used for electronic drums. In the case where the foot switch is used, for example. A tempo may be calculated based on intervals of operations to change a particular parameter, e.g., a delay time, based on the calculated tempo. The controller 50 may calculate a tempo based on the sound signal obtained from the sound pickup device 10. Also, the operation unit 570 may be operated from a personal computer or a smartphone, for example.

The sound-signal producer 515 creates a sound signal based on the strike signal output from the strike detector 580. This sound signal is created using a sound waveform registered in advance. For example, the sound signal is created by reading from a memory, a waveform obtained by recording a strike sound of the bass drum. Various kinds of waveforms may be registered into the memory to enable the user to operate the operation unit 570 to switch a waveform to be read.

The sound processor 513 is configured to add a sound effect based on a set parameter to the sound signal input from the sound-signal producer 515 and configured to output the sound signal with the sound effect. It is noted that the sound processor 513 adds the sound effect to a sound signal that is different from the sound signal to which the sound effect is added by the sound processor 511. This parameter is changeable via the operation unit 570 as described above.

When a sound effect is added to a raw sound of the bass drum 810, a special signal processing is preferably executed because of effects of properties of the sound. Thus, the controller 50 in some cases preferably executes a sound processing different from that for a sound signal (e.g., the sound signal input from the sound pickup device 10) containing lots of sounds other than sound emitted from the bass drum 810. In these cases, appropriate processings can be executed for the respective sounds not by adding a sound effect to the raw sound of the bass drum 810 but by adding a sound effect to a sound signal created by the sound-signal producer 515 based on the sound emitted from the bass drum 810. It is noted that the same sound effect may be added to both of the sound signal for the bass drum 810 and the sound signal containing lots of sounds other than sound emitted from the bass drum 810. In the case where the same sound effect is added, the controller 50 may be configured to add the sound effect after the sound signal produced by the sound-signal input portion 591 and the sound signal produced by the sound-signal producer 515 are synthesized with each other (in this case, the sound processors 511, 513 are configured integrally with each other).

The output portion 550 is a terminal to which an external device is connected by a cable, for example. The output portion 550 is configured to synthesize the sound signal output from the sound processor 511 and the sound signal output from the sound processor 513 with each other and configured to output the synthesized sound signal. A ratio of the synthesis may be set via the operation unit 570 and may be set in advance in accordance with (i) a degree of amplification of the sound signal and the vibration signal in the circuit board 111, (ii) an ability of the microphone L113 and the microphone R115 at picking up sounds, and (iii) a detection ability of the sensor 120.

The sound signal output from the output portion 550 is supplied to an external device (e.g., headphones) connected to the output portion 550. This configuration enables the player of the drum set to use the sound emitter, such as the headphones, to listen to performance sounds emitted from the drum set and picked up by the sound pickup portion 110 and sounds created based on strike of the bass drum 810. Sound effects may be added to these sounds to give the player a feeling of listening to sounds produced by a CD player though the sounds are based on real-time playing of the player.

Configuration of Sound Pickup Device

Figure 5:
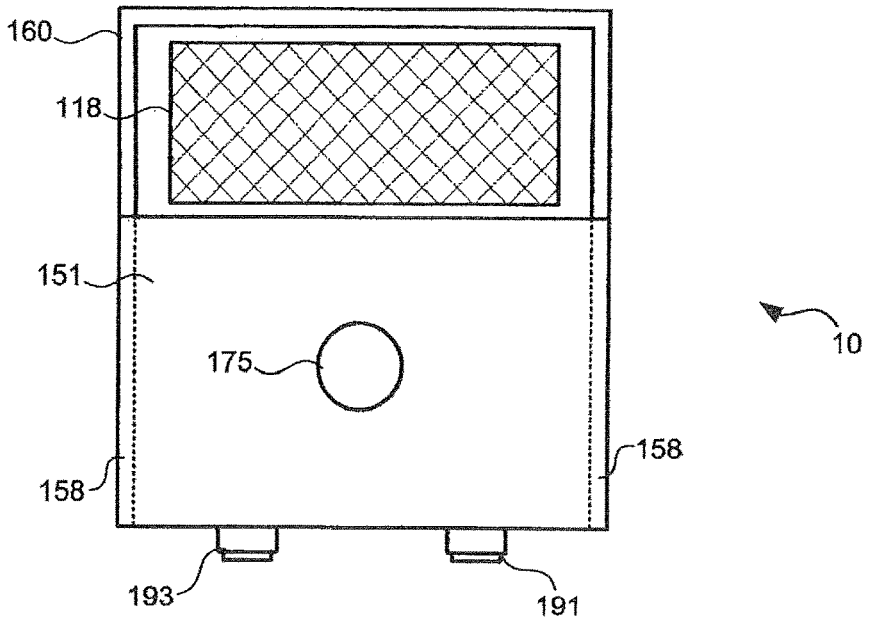
FIG. 5 is a view of the sound pickup device according to the first embodiment which is viewed from above.
Figure 6:
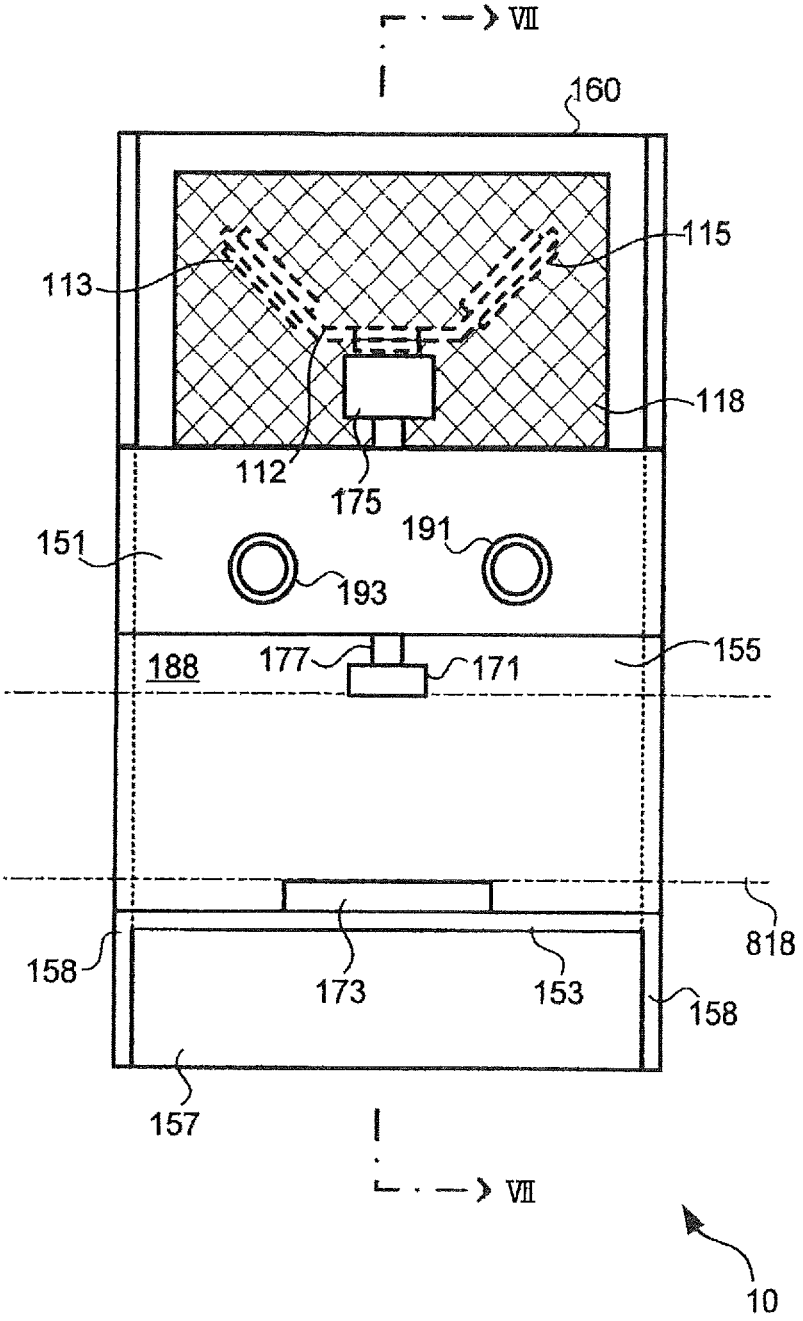
FIG. 6 is a view of the sound pickup device according to the first embodiment which is viewed from a back side thereof.
Figure 7:
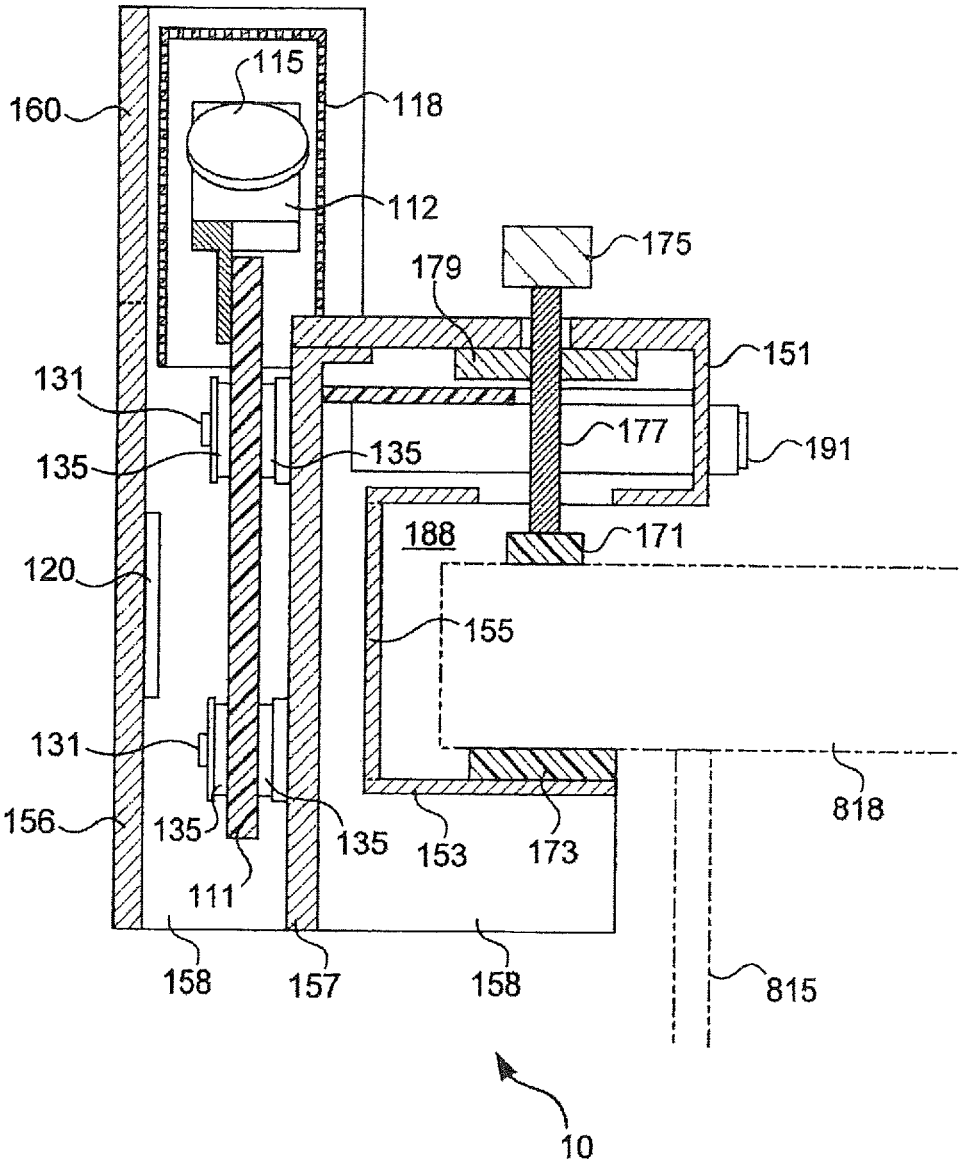
FIG. 7 is a schematic cross-sectional view taken along line VII-VII in FIG. 6.

There will be next explained the configuration of the sound pickup device 10. FIG. 5 is a view of the sound pickup device 10 viewed from above. FIG. 6 is a view of the sound pickup device 10 viewed from a back side thereof. FIG. 7 is a schematic cross-sectional view taken along line VII-VII in FIG. 6. A metal mesh 118 is disposed on an upper portion of the sound pickup device 10 so as to cover the microphone L113 and the microphone R115. The microphone L113 and the microphone R115 are supported by a support plate 112. The support plate 112 positions the microphone L113 and the microphone R115 with respect to the circuit board 111. The microphone cover 160 covers the metal mesh 118 from three sides, i.e., front, right, and left sides.

The housing 150 has an upper area 151, a lower area 153, an intermediate area 155, a front area 156, an inner area 157, and side areas 158. These areas are directly or indirectly connected to each other, with a fixed positional relationship. The upper area 151 is located at an upper portion of the housing 150 and corresponds to an area located above a position at which the shell 818 is mounted. The lower area 153 is located at a lower portion of the housing 150 and corresponds to an area located below the position at which the shell 818 is mounted. The intermediate area 155 connects the upper area 151 and the lower area 153 to each other. A recessed area 188 is formed at the upper area 151, the lower area 153, and the intermediate area 155. The recessed area 188 has an opening in its back surface. The shell 818 is inserted into the recessed area 188 through the opening from a back side of the recessed area 188.

The front area 156 corresponds to a front area of the housing 150. The inner area 157 is disposed between the intermediate area 155 and the front area 156. The side areas 158 are located on the opposite sides of each of the upper area 151, the lower area 153, the intermediate area 155, the front area 156, and the inner area 157 and connect these areas to each other. In this example, the microphone cover 160 extends over the front area 156 of the housing 150 and upper portions of the side areas 158. That is, the microphone cover 160 and a portion of the housing 150 are formed integrally with each other.

The shell 818 inserted in the recessed area 188 is held by the mount portion 170 in the up and down direction, whereby the mount portion 170 secures the housing 150 to the shell 818. The mount portion 170 includes an upper supporter 171, a lower supporter 173, a knob 175, a shaft 177 and a direction converter 179. The lower supporter 173 is fixed to the lower area 153 of the housing 150. The direction converter 179 is fixed to the upper area 151 of the housing 150.

When the shaft 177 is rotated by rotation of the knob 175, the direction converter 179 converts movement in a rotational direction to movement in the up and down direction. For example, in the case where the shaft 177 has a male thread, and the direction converter 179 has a female thread, the direction converter 179 converts movement of the shaft 177 in its rotational direction to movement thereof in the up and down direction. The movement of the shaft 177 in the up and down direction moves the upper supporter 171 in the up and down direction. As a result, the shell 818 inserted in the recessed area 188 is held by the upper supporter 171 and the lower supporter 173. Thus, the mount portion 170 mounts the housing 150 onto the shell 818 by a clamp mechanism.

In this example, the sensor 120 is disposed on the front area 156 of the housing 150. In this example, the sensor 120 has a planar shape for efficiently detecting vibrations. The sensor 120 is disposed in parallel with the circuit board 111 so as to be opposed to the circuit board 111. The vibration of the bass drum 810 is transmitted to the sensor 120 via the shell 818, the mount portion 170, and the housing 150. It is noted that the sensor 120 may be disposed at a position of the housing 150 different from the front area 156. For example, the sensor 120 may be disposed at the inner area 157, the side areas 158, the intermediate area 155, or the lower area 153. Also, the sensor 120 may be movable and directly bonded to the bass drum 810 (e.g., to the striking surface 815).

Each of the sound-signal output portion 191 and the vibration-signal output portion 193 has an opening for insertion of a plug of a cable, for example. Each of the sound-signal output portion 191 and the vibration-signal output portion 193 is disposed at the upper area 151 of the housing 150 such that the opening faces backward, i.e., toward the opening of the recessed area 188. This arrangement prevents interference between the striking surface 815 of the bass drum 810 (i.e., an area inside the cylindrical region of the shell 818) and the cables connected to the sound-signal output portion 191 and the vibration-signal output portion 193, for example. The microphone L113 and the microphone R115 are located outside the cylindrical region of the shell 818. The sound-signal output portion 191 and the vibration-signal output portion 193 are located between the recessed area 188 and each of the microphone L113 and the microphone R115 in the up and down direction.

It is noted that, in this example, the upper area 151 of the housing 150 protrudes backward near the opening of the recessed area 188 by a greater amount than the lower area 153. This construction prevents interference between the lower area 153 and the striking surface 815. Also, since the upper area 151 is large, it is possible to easily form an area at which the shaft 177 and the direction converter 179 of the mount portion 170 are arranged.

In this example, the connector 130 includes fasteners 131 and vibration absorbers 135 and connects the circuit board 111 of the sound pickup portion 110 and the inner area 157 of the housing 150 to each other. The fasteners 131 of the connector 130 secure the circuit board 111 and the inner area 157 to each other. The circuit board 111 and the inner area 157 are arranged, with the vibration absorbers 135 interposed therebetween, and connected to each other via the vibration absorbers 135. The vibration absorbers 135 are formed of a cushioning material such as rubber, for example. When the housing 150 is vibrated, the vibration absorbers 135 reduce vibrations by reducing transmission thereof from the inner area 157 to the circuit board 111. With this construction, the vibrations given to the housing 150 are transmitted to the sensor 120 but transmitted to the microphone L113 and the microphone R115 with reduced amount. Transmission of the vibrations to the circuit board 111 is also reduced, thereby protecting electronic components. Also, cables extending from the microphone L113 and the microphone R115 to the circuit board 111 are not vibrated individually, resulting in improved strength of connecting portions. Also, a large space for the vibration absorbers 135 is provided.

In the above-described construction, the sound pickup portion 110 (including the circuit board 111, the microphone L113, and the microphone R115) has a particular resonant frequency. To adjust this resonant frequency to a desired frequency, for example, to make the resonant frequency less than or equal to audible frequencies, a weight may be connected to the circuit board 111 or the support plate 112 to change the weight of the circuit board 111 or the support plate 112.

The connector 130 positions the sound pickup portion 110 with respect to the housing 150. That is, in the case where the housing 150 is mounted on the shell 818, the connector 130 determines the position and orientation (i.e., an oriented direction) of each of the microphone L113 and the microphone R115 of the sound pickup portion 110. Each of the microphone L113 and the microphone R115 is oriented in a direction away from the shell 818. In this example, the direction away from the shell 818 is a direction away from a portion of the shell 818 which contacts the mount portion 170. It is noted that the direction away from the shell 818 may be a direction away from the center (the center of gravity) of the cylindrical region of the shell 818.

That is, the directions in which the microphone L113 and the microphone R115 are oriented are determined by the one bass drum 810 such that the microphone L113 and the microphone R115 principally pick up sounds emitted from components of the drum set other than the bass drum 810 along the striking surface 815 of the bass drum 810, for example. Thus, in the present embodiment, the two microphones are provided in the single unit, and the positional relationship between the two microphones is determined in the unit. A simple operation of installing this small unit on the bass drum 810 enables sound pickup with appropriate localization for the entire drum set constituted by a plurality of drums and cymbals.

Figure 8:
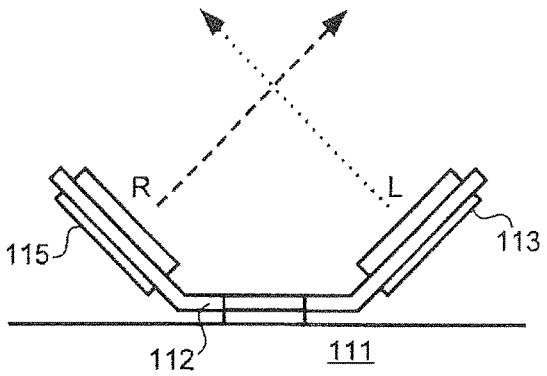
FIG. 8 is a view for explaining a positional relationship between microphones of the sound pickup portion in the first embodiment.

FIG. 8 is a view for explaining a positional relationship between the microphones of the sound pickup portion in the first embodiment. FIG. 8 illustrates a positional relationship between the microphone L113 and the microphone R115 in the case where the sound pickup device 10 is viewed from the front. The microphone L113 and the microphone R115 are arranged such that their respective oriented directions intersect each other (that is, regions extending along their respective oriented directions overlap each other). The arrangement of the microphone L113 and the microphone R115 oriented inward is one example of arrangement of microphones in stereo recording and generally called X-Y placement. It is noted that, when the sound pickup device 10 is fastened to the bass drum 810, the distance between the microphone L113 and the microphone R115 and the angle of the oriented directions may be set such that the microphone L113 and the microphone R115 can appropriately pick up sounds emitted from the components of the drum set other than the bass drum 810.

Figure 9:
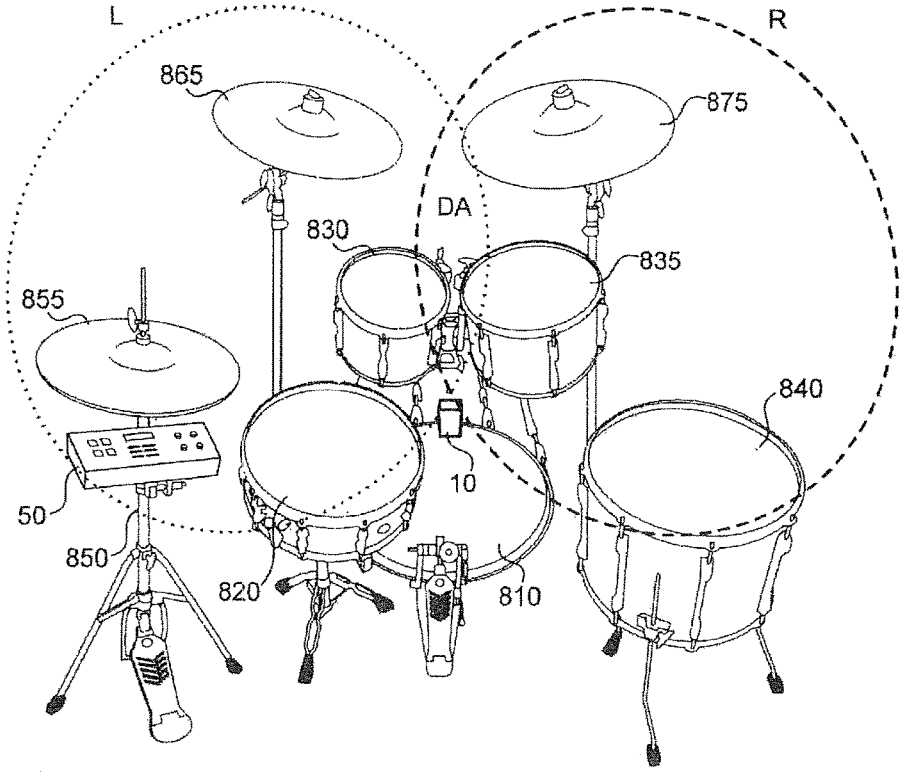
FIG. 9 is a view for explaining a sound pickup area of the sound pickup device according to the first embodiment.

FIG. 9 is a view for explaining a sound pickup area of the sound pickup device according to the first embodiment. In this example, a sound pickup area R of the microphone L113 includes a low tom 835, a floor tom 840, and a ride cymbal 875 and principally includes an area extending from a front side to a right side of the player. A sound pickup area L of the microphone R115 includes a high tom 830, a snare drum 820, a crash cymbal 865, and a high-hat cymbal 855 and includes an area extending from a front side to a left side of the player. In this example, the sound pickup area R and the sound pickup area L have an overlapped area DA. The area DA is located at an area different from the bass drum 810 to which the sound pickup device 10 is fastened. In this example, the area DA is located over the bass drum 810. In the case where the sound pickup area of the sound pickup device 10 is described in other words, the sound pickup area is defined as follows. As illustrated in FIG. 9, the housing 150 of the sound pickup device 10 is installed on the bass drum 810 located at a central portion of the drum set in the right and left direction. In this state, the sound pickup area L of the microphone L113 includes: the area DA located over the bass drum 810; and an area located to the left of the bass drum 810 located at the central portion. The sound pickup area R of the microphone R115 includes: the area DA located over the bass drum 810; and an area located to the right of the bass drum 810 located at the central portion. The distance between the microphones L113, R115 and the angle between the oriented directions of the microphones L113, R115 are set in the housing 150, and the housing 150 is connected to the bass drum 810 by the connector 130 such that the sound pickup areas of the microphones L113, R115 coincide with the above-described area. The sound pickup areas R, L do not include the bass drum 810. It is noted that each of the sound pickup areas is an area at which sounds can be picked up at levels higher than or equal to a particular level, that is, the microphone may pick up sounds at an area different from the sound pickup area.

In the present embodiment as described above, the sound pickup device 10 is placed at a predetermined position (the upper portion of the bass drum 810 in this example) and picks up sounds emitted from the drums and the cymbals. Only a small amount of sounds emitted from the bass drum 810 are picked up by the microphone, but vibrations of the bass drum 810 are detected by the sensor 120. The controller 50 produces, based on the vibration signal, a sound signal corresponding to a sound of the bass drum, for example. The controller 50 adds a sound effect to the produced sound signal and the sound signal acquired from the sound pickup device 10 and outputs the sound signals with sound effect.

When the player uses headphones to listen to sounds produced based on the sound signal output from the controller 50, the user listens, from the headphones, to performance sounds picked up by the sound pickup device 10 and sounds of the bass drum which are produced based on the vibrations of the bass drum 810, while a certain amount of raw sounds in playing of the drum set is interrupted by the headphones. Also, the sound pickup area is determined appropriately by placing the sound pickup device 10 at an assumed position of a musical instrument without adjustment of the position of the sound pickup device 10 with respect to the microphones L113, R115. Thus, the performance sounds are localized. It is noted that the inventors have found by experiment that setting the sound pickup area extending from a central portion toward a side portion of the drum set is effective for obtaining the performance sounds of the drum set. That is, the housing 150 containing the microphones L113, R115 is placed on the bass drum 810 located at the central portion of the drum set in the right and left direction. The microphones L113, R115 are placed in the housing 150 such that the sound pickup areas of the microphones L113, R115 include: an area located to the right of the bass drum 810; and an area located to the left of the bass drum 810 in the state in which the housing 150 is installed on the bass drum 810. Since the microphones L113, R115 are placed in advance in this arrangement, when the housing 150 is placed at the assumed position of the musical instrument, the sound pickup area is determined appropriately.

The sound pickup area of the sound pickup device 10 and the positional relationship and the number of the microphones are not limited to those in the above-described embodiment. The sound pickup device 10 preferably includes the microphones oriented away from the shell 818 to which the sound pickup device 10 is fastened, and some of the microphones are preferably placed such that their respective orientations are set for stereo recording. Examples of the placement of the microphones for stereo recording include X-Y placement, A-B placement, and M-S placement. Also, the microphones are arranged in the right and left direction in the above-described embodiment but may be arranged in any direction for stereo recording, such as the front and rear direction. Second to fifth embodiments represent examples of the positional relationship and the number of the microphones. Also, the sound pickup device 10 is fastened to the shell 818 of the bass drum 810 but may be fastened to a component different from the shell 818 and connected to the shell 818. Sixth to eighth embodiments represent examples of the sound pickup device installed on the lugs 816. It is noted that the sound pickup device 10 may be fastened to a hoop though not represented as an embodiment.

Second Embodiment

Figure 10:
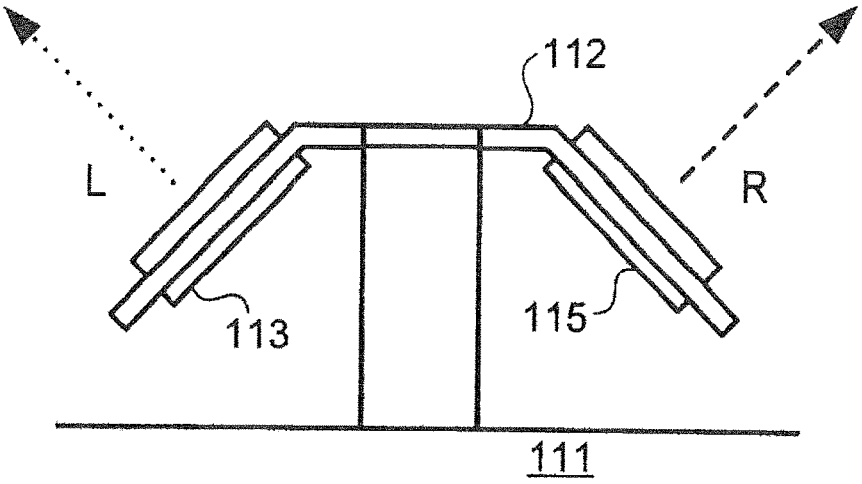
FIG. 10 is a view for explaining a positional relationship between microphones of a sound pickup portion in a second embodiment.

FIG. 10 is a view for explaining a positional relationship between microphones of a sound pickup portion in the second embodiment. Like FIG. 8, FIG. 10 illustrates the positional relationship between the microphones in the case where the sound pickup device 10 is viewed from the front. The second embodiment differs from the first embodiment in arrangement of the microphone L113 and the microphone R115. The sound pickup areas of the microphone L113 and the microphone R115 in the second embodiment are similar to those in the first embodiment. In the second embodiment, the microphone L113 and the microphone R115 are supported by the support plate 112 so as to be oriented outward without their respective oriented directions intersecting each other. This arrangement of the microphones is another example of arrangement of microphones in stereo recording and is generally called A-B placement.

Also in the present embodiment as described above, the two microphones are provided in the single unit, and the positional relationship between the two microphones is determined in the unit. A simple operation of installing this small unit on the bass drum 810 enables sound pickup with appropriate localization for the entire drum set constituted by a plurality of drums and cymbals.

Third Embodiment

Figure 11:
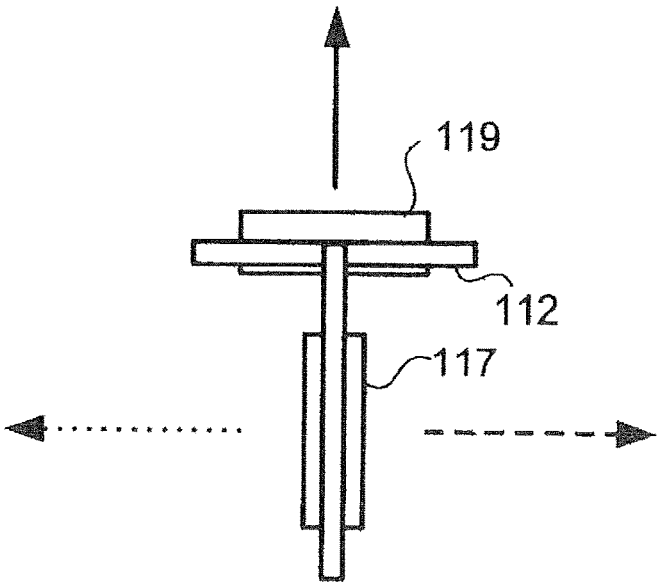
FIG. 11 is a view for explaining a positional relationship between microphones of a sound pickup portion in a third embodiment.

FIG. 11 is a view for explaining a positional relationship between microphones of a sound pickup portion in the third embodiment. FIG. 11 illustrates the positional relationship between the microphones in the case where the sound pickup device 10 is viewed from above. It is noted that a lower side in FIG. 11 corresponds to a front side (user side) of the sound pickup device 10. The third embodiment differs from the first embodiment in the two microphones and their functions. In the third embodiment, the support plate 112 supports a bi-directional microphone 117 and a unidirectional microphone 119.

The bi-directional microphone 117 has bi-directivity. In this example, the two oriented directions coincide with the right and left direction in the case where the sound pickup device 10 is viewed from the player. The unidirectional microphone 119 has only one directivity. In this example, the unidirectional microphone 119 is oriented backward. This arrangement of the microphones is yet another example of arrangement of microphones in stereo recording and is generally called M-S placement. Signals output from the microphone are calculated by an arithmetic circuit of the circuit board 111 and converted to stereo two-channel signals.

Also in the present embodiment as described above, the two microphones are provided in the single unit, and the positional relationship between the two microphones is determined in the unit. A simple operation of installing this small unit on the bass drum 810 enables sound pickup with appropriate localization for the entire drum set constituted by a plurality of drums and cymbals.

Fourth Embodiment

Figure 12:
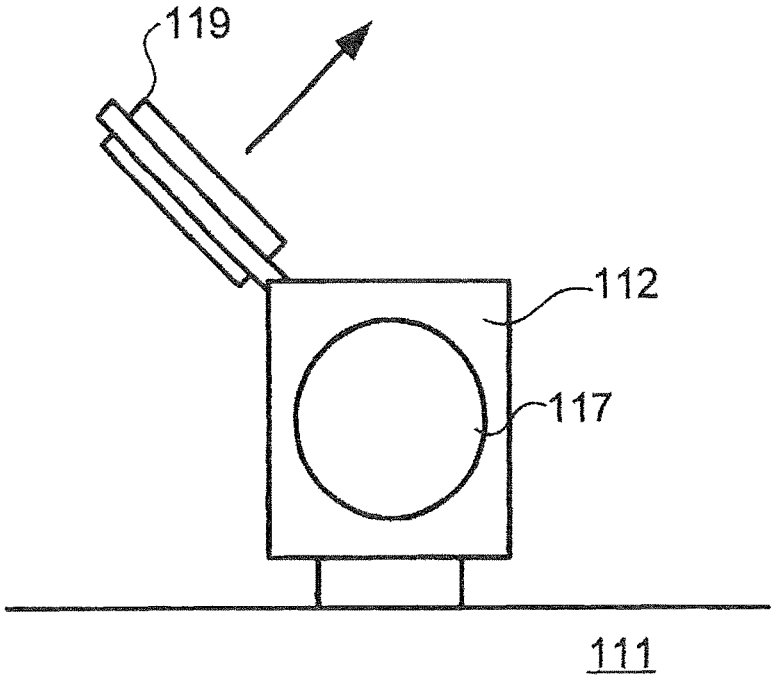
FIG. 12 is a view for explaining a positional relationship between microphones of a sound pickup portion in a fourth embodiment.

FIG. 12 is a view for explaining a positional relationship between microphones of a sound pickup portion in the fourth embodiment. Like FIG. 8, FIG. 12 illustrates the positional relationship between the microphones in the case where the sound pickup device 10 is viewed from the front. The fourth embodiment and the third embodiment are the same as each other in that the microphones are arranged in M-S placement but different from each other in the oriented direction of the unidirectional microphone 119. In the third embodiment, the unidirectional microphone 119 is oriented substantially backward (in a direction in which the player views the sound pickup device 10). In the fourth embodiment, in contrast, the unidirectional microphone 119 is supported by the support plate 112 so as to be oriented obliquely upward.

Also in the present embodiment as described above, the two microphones are provided in the single unit, and the positional relationship between the two microphones is determined in the unit. A simple operation of installing this small unit on the bass drum 810 enables sound pickup with appropriate localization for the entire drum set constituted by a plurality of drums and cymbals.

Fifth Embodiment

Figure 13:
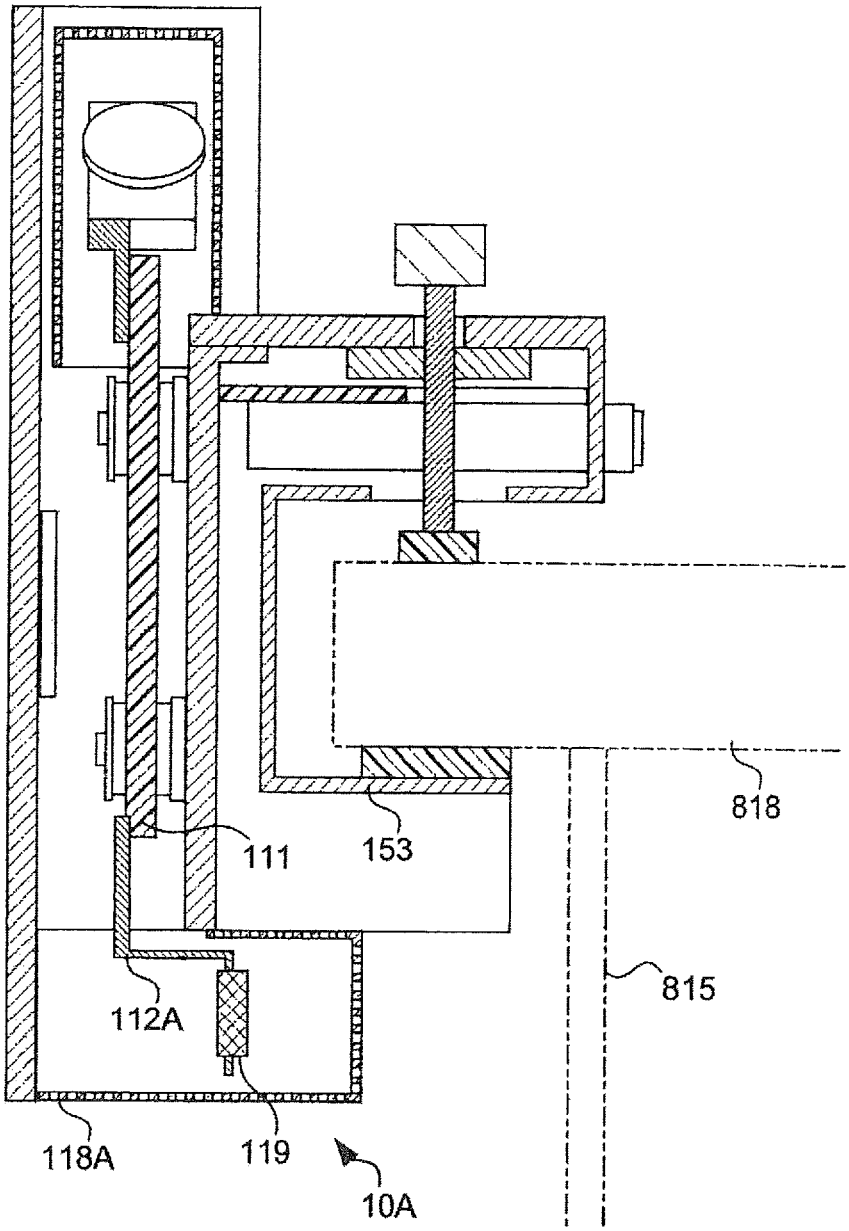
FIG. 13 is a view for explaining a positional relationship between microphones of a sound pickup portion in a fifth embodiment.

FIG. 13 is a view for explaining a positional relationship between microphones of a sound pickup portion in the fifth embodiment. FIG. 13 corresponds to FIG. 7 and illustrates a sound pickup device 10A. While the sound pickup device 10 according to the first embodiment includes the two microphones, the sound pickup device 10A includes three microphones. The three microphones include the microphone L113 and the microphone R115 as in the first embodiment and further include the unidirectional microphone 119.

This unidirectional microphone 119 is supported by a support plate 112A connected to the circuit board 111. The unidirectional microphone 119 is disposed in a lower portion of the sound pickup device 10A at a position opposed to the striking surface 815. The unidirectional microphone 119 is covered with a metal mesh 118A. In this example, the unidirectional microphone 119 is oriented toward the striking surface 815, and a sound pickup area of the unidirectional microphone 119 includes the bass drum 810. Signals based on sounds picked up by the unidirectional microphone 119 among sound signals output from the sound pickup device 10A may be contained in a third channel different from the stereo two channels and may be contained in the stereo two channels so as to be localized to a center.

In the present embodiment as described, the three microphones are provided in the single unit, and the positional relationship between the three microphones is determined in the unit. A simple operation of installing this small unit on the bass drum 810 enables sound pickup with appropriate localization for the entire drum set constituted by a plurality of drums and cymbals.

Sixth Embodiment

Figure 14:
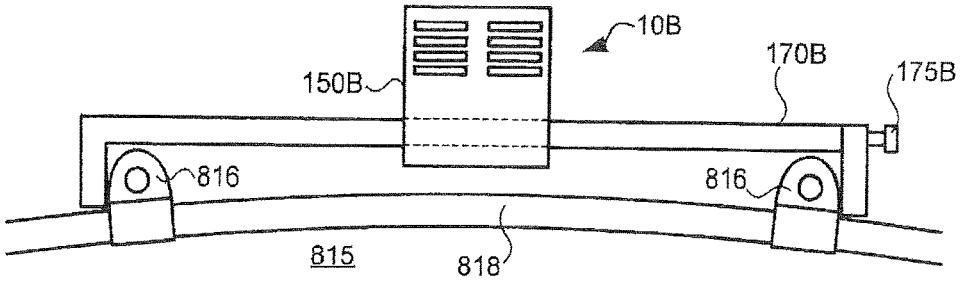
FIG. 14 is a view for explaining a method of installing a sound pickup device according to a sixth embodiment.

FIG. 14 is a view for explaining a method of installing a sound pickup device according to the sixth embodiment. A sound pickup device 10B is similar in construction to the sound pickup device 10 according to the first embodiment except a construction of a mount portion 170B, and an explanation of the similar construction is dispensed with. The mount portion 170B is configured to mount a housing 150B onto two lugs 816 and includes a mechanism for changing a distance between opposite ends of the mechanism to hold the two lugs 816 from outer sides thereof when the knob 175B is rotated, that is, the mount portion 170B includes a clamp mechanism for securing the housing 150B. It is noted that the housing 150B and the mount portion 170B may be formed integrally with each other or independently of each other. In the case where the housing 150B and the mount portion 170B are formed independently of each other, the sound pickup device 10B may be made similar in construction to the sound pickup device 10 according to the first embodiment and constructed such that the mount portion 170 pinches and holds the mount portion 170B in the present embodiment.

Also in the present embodiment as described above, the two microphones are provided in the single unit, and the positional relationship between the two microphones is determined in the unit. A simple operation of installing this small unit on the bass drum 810 enables sound pickup with appropriate localization for the entire drum set constituted by a plurality of drums and cymbals.

Seventh Embodiment

Figure 15:
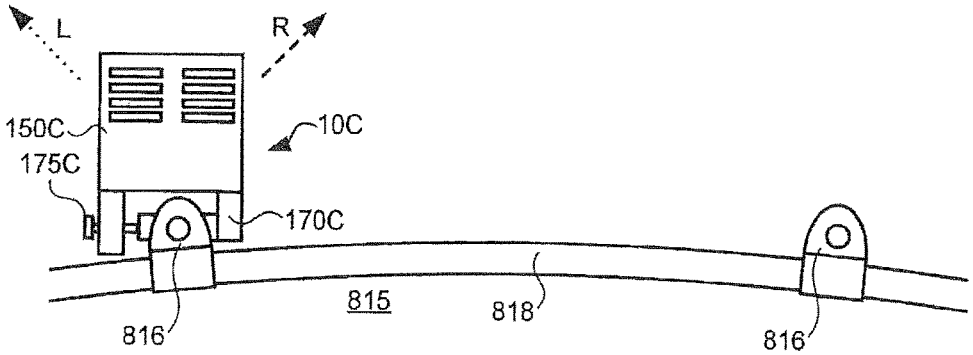
FIG. 15 is a view for explaining a method of installing a sound pickup device according to a seventh embodiment.

FIG. 15 is a view for explaining a method of installing a sound pickup device according to the seventh embodiment. A sound pickup device 10C is similar in construction to the sound pickup device 10 according to the first embodiment except a construction of a mount portion 170C, and an explanation of the similar construction is dispensed with. The mount portion 170C is configured to mount a housing 150C onto one lug 816 and includes a mechanism for changing a distance between opposite ends of the mechanism to hold the lug 816 from an outer side thereof when a knob 175C is rotated, that is, the mount portion 170C includes a clamp mechanism for securing the housing 150C.

Also in the present embodiment as described above, the two microphones are provided in the single unit, and the positional relationship between the two microphones is determined in the unit. A simple operation of installing this small unit on the bass drum 810 enables sound pickup with appropriate localization for the entire drum set constituted by a plurality of drums and cymbals.

Eighth Embodiment

Figure 16:
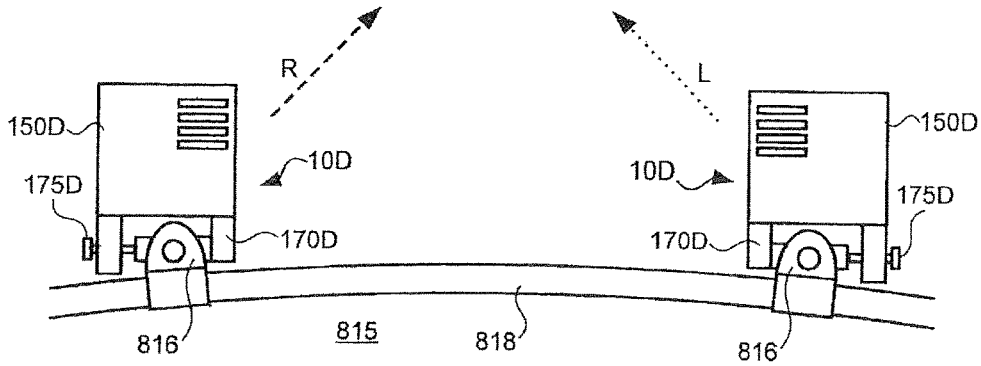
FIG. 16 is a view for explaining a method of installing sound pickup devices according to an eighth embodiment.

FIG. 16 is a view for explaining a method of installing a sound pickup device according to the eighth embodiment. Sound pickup devices 10D are separately configured for right and left channels and similar in configuration to the sound pickup device 10C according to the seventh embodiment except for each of the sound pickup devices 10D containing a single microphone. Like the mount portion 170C according to the seventh embodiment, each of mount portions 170D includes a clamp mechanism configured to pinch and hold the lug 81 by opposite ends of the mount portion 170D when a knob 175D is rotated. This operation secures a housing 150D to the lug 816. In the eighth embodiment, the sound pickup devices 10D having the sound pickup area R illustrated in FIG. 9 and the sound pickup devices 10D having the sound pickup area L illustrated in FIG. 9 have a function corresponding to that of the sound pickup device 10 according to the first embodiment. The sound pickup devices 10D are supported by the respective lugs 816 of the drum, thereby determining directions in which the microphones provided in the respective sound pickup devices 10D are oriented.

Also in the present embodiment as described above, the position of the microphone is determined in the unit. A simple operation of installing this small unit on the bass drum 810 enables sound pickup with appropriate localization for the entire drum set constituted by a plurality of drums and cymbals.

It is noted that the sound pickup devices 10D may respectively include the respective sensors 120, and the controller 50 may use a vibration signal or signals output from only one of or both of the sensors 120. In the case where a vibration signal output from only one of the sensors 120 is used, a circuit for processing the signal output from the sensor 120 may be stopped. Use of a plurality of the sound pickup devices enables the present disclosure to be applied to a drum set using two bass drums. In this case, the controller 50 may use the vibration signals output from the sensors 120 to produce sound signals based on strikes of striking surfaces of the bass drums.

The two sound pickup devices 10D may have a mechanism to couple the sound pickup devices 10D to each other. In this case, the two sound pickup devices 10D may be configured to achieve the same function as that of the sound pickup device 10 according to the first embodiment when the two sound pickup devices 10D are coupled to each other.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure.

The output portion 550 may further synthesize sound signals obtained from an external device other than the sound pickup device 10. In this case, the controller 50 at least needs to include an input terminal for obtaining the sound signal from the external device. For example, in the case where the external device is an audio player, when the controller is configured to obtain sound signals obtained by reproduction of audio data, the player can listen to performance sounds with reproduced sounds. This configuration enables the player to play to the accompaniment of a favorite musing while listening to the music. The player has a feeling of listening to a CD in the case where the player listens to the favorite music and performance sounds with sound effect than in the case where the user listens to raw sounds emitted from the drum set beyond headphones while listening to the favorite music.

Another microphone may be connected to the input terminal of the controller 50. In this case, the controller 50 may control the sound processor to execute a processing for adding sound effects to sound signals obtained by pickup of sounds by said another microphone connected to the input terminal and control the output portion 550 to synthesize the sound signals. The sound processor for adding sound effects to the sound signals produced by said another microphone may be used with the sound processor 511 and may be provided independently of the sound processor 511. With this configuration, in the case where there is at least one sound source (e.g., a drum and a cymbal) not covered by the sound pickup area of the sound pickup device 10 due to arrangement or combination of the instruments of the drum set, for example, another microphone is connected to the controller 50. The sound pickup area is substantially enlarged by synthesizing sound signals produced based on sounds picked up by the microphone with sound signals produced based on signals output from the sound pickup device 10 as described above.

In the above-described embodiment, the positional relationship among the circuit board 111, the microphone L113, and the microphone R115 is fixed via the support plate 112, and transmission of vibrations transferred to the housing 150 is reduced by the connector 130. The circuit board 111 may be directly connected to the housing 150. Also in this case, the sound pickup device 10 at least needs to have a configuration (corresponding to the vibration absorbers 135) in which the connector 130 reduces transmission of the vibrations among the microphone L113, the microphone R115, and the housing 150. In any configuration, it is at least required to make it difficult for vibrations transmitted to the housing 150 to reach the microphone L113 and the microphone R115.

In the above-described embodiment, the sensor 120 is used to convert sounds emitted from the bass drum 810 to sound signals. However, the sensor 120 may not be used. In this case, the sound pickup area of the microphone needs to contain the bass drum 810.

In the above-described embodiment, the sound pickup device 10 is installed on the shell 818 partly constituting the drum set. However, in the case of a plurality of timpani, for example, the sound pickup device 10 may be installed on one of the timpani to pick up sounds emitted from the plurality of timpani during playing. The sound pickup device 10 may be installed on another percussion instrument. It is noted that the sound pickup device 10 may be installed on a musical instrument different from the percussion instrument. Examples of the musical instrument include an instrument, such as a guitar, a piano, and a cajon, which includes a plate-like component which vibrates as a sound emitting component like a sound board or a shell. Moreover, the musical instrument may have strings as a sound source, for example. In any instrument, the microphone needs to be disposed such that its sound pickup area is set at an appropriate area when the sound pickup device is installed on an assumed position of the musical instrument. That is, the sound pickup device at least needs to have a configuration in which the sound pickup device is installed on an appropriate position or component depending upon a type of a musical instrument on which the sound pickup device is installed. The present disclosure is applied to the musical instrument generally called an acoustic drum in the above-described embodiment but may be applied to a drum set with reduced volume of output sounds. Examples of the drum set include an electronic drum using electricity, a mesh pad, and a perforated cymbal.

The sound pickup portion 110 may be separable from other components. In this case, the connector 130 at least needs to be configured to connect the sound pickup portion 110 to the housing 150 detachably such that, when the sound pickup portion 110 is connected to the housing 150 by the connector 130, the sound pickup area of the microphone is defined as a preset area (e.g., the area set in the first embodiment). In this case, the housing 150 and the mount portion 170 function as an attachment for connecting the sound pickup portion 110 and the bass drum 810 to each other. Thus, a connector may be provided for connecting the sound pickup portion 110 to the sound-signal output portion 191, and the sound-signal output portion 191 may be connected to the sound pickup portion 110.

The sensor 120 of the sound pickup device 10 may be provided on the shell or the hoop of the bass drum 810. In this case, the sound pickup device 10 at least needs to include a connector for receiving signals output from the sensor, for example.

The mount portion 170 of the sound pickup device 10 has the function for installing the housing 150 on the shell 818 using the clamp mechanism in the above-described embodiments, but the present disclosure is not limited to this configuration. For example, the mount portion 170 may include a portion of a component connected to the shell 818 among the components of the bass drum 810. For example, in the case where the housing 150 is provided integrally with the hoop, a portion of the hoop serves as the mount portion for installing the housing 150 on the shell 818. In the case where the housing 150 is provided integrally with the lug 816, a portion of the lug 816 serves as the mount portion for installing the housing 150 on the shell 818.

In the case where the sound pickup portion 110 includes a plurality of the microphones, the controller 50 may execute calculation for determining orientations of drums and cymbals of the drum set and produce sound signals corresponding to sounds emitted from the respective instruments. Moreover, the controller 50 may add sound effects individually to the sound signals.

In the above-described embodiments, the housing is provided independently of the sound pickup device 10 and the controller 50 of the sound processing device 1 but may be provided integrally with the sound pickup device 10 and the controller 50.

What is claimed is:

1. A sound pickup device comprising:

a housing;

a mounting mechanism configured to mount the housing to portion of a musical instrument;

a sound pickup portion comprising a support plate and a plurality of microphones mounted to the support plate, which is configured to orient the plurality of microphones in different directions;

a first output terminal that outputs a sound signal corresponding to a sound picked up by the plurality of microphones; and a connector configured to mount the sound pickup portion inside the housing so that each of the plurality of microphones becomes oriented away from the musical instrument, in a state where the housing is mounted to the portion of the musical instrument via the mounting mechanism.

2. The sound pickup device according to claim 1, wherein at least two of the plurality of the microphones are disposed so that sound is pickupable from an overlapping area located outside the musical instrument, in a state where the housing is mounted to the portion of the musical instrument via the mounting mechanism.

3. The sound pickup device according to claim 1, wherein:

the musical instrument has a cylindrical region, and the connector is configured to mount the sound pickup portion to the housing so that each of the plurality of microphones is located outside the cylindrical region, in a state where the housing is mounted to the portion of the musical instrument via the mounting mechanism.

4. The sound pickup device according to claim 1, wherein:

the housing includes a recessed area configured to receive the portion of the musical instrument, the mounting mechanism is configured to secure the portion of the musical instrument disposed in the recessed area, to the housing, and the first output terminal is disposed between the recessed area and the sound pickup portion and located on a first side opposite to a second side where the recessed area opens to.

5. The sound pickup device according to claim 4, further comprising a cover covering at least portion of the plurality of microphones from the first side.

6. The sound pickup device according to claim 1, wherein:

in a state where the housing is mounted to the portion of the musical instrument, the housing is centrically disposed of the musical instrument relative to a first direction along the musical instrument, the connector is configured to mount the sound pickup portion to the housing to provide, from at least two of the plurality of the microphones, a first sound pickup area and a second sound pickup area, the first sound pickup area includes:

an upper area located above the portion of the musical instrument in a state where the housing is mounted to the portion of the musical instrument via the mounting mechanism; and an area located on a first side of the upper area in the first direction, and the second sound pickup area includes:

the upper area; and an area located on a second side of the upper area in the first direction, the second side being different from the first side.

7. The sound pickup device according to claim 1, wherein the connector is configured to mount the sound pickup portion to the housing with the musical instrument not disposed in a sound pickup area of each of at least two of the plurality of the microphones, in a state where the housing is mount to the portion of the musical instrument via the mounting mechanism.

8. The sound pickup device according to claim 1, wherein:

in a state where the housing is mounted to the portion of the musical instrument, the housing is centrically disposed of the musical instrument relative to in a first direction along the musical instrument, and the connector is configured to mount the sound pickup portion to the housing to provide, from at least two of the plurality of the microphones, a first sound pickup area located on a first side of the musical instrument in the first direction and a second sound pickup area located on a second side of the musical instrument in the first direction, the second side being different from the first side.

9. The sound pickup device according to claim 1, wherein the portion of the musical instrument is one of a shell of a drum or a component connected to the shell.

10. The sound pickup device according to claim 1, wherein the connector includes a vibration absorbing member configured to absorb vibration transmitted between the housing and the sound pickup portion.

11. The sound pickup device according to claim 10, wherein:

the sound pickup portion includes a board with a circuit configured to amplify a signal output from each of the plurality of microphones, and the connector mounts the board to the housing.

12. The sound pickup device according to claim 11, further comprising:

a sensor connected to the housing and configured to detect vibration transmitted to the housing; and a second output terminal configured to output a vibration signal indicating the vibration detected by the sensor.

13. A sound processing device comprising:

a housing;

a mounting mechanism configured to mount the housing to portion of a musical instrument;

a sound pickup portion comprising a support plate and a plurality of microphones mounted to the support plate, which is configured to orient the plurality of microphones in different directions;

a first output terminal that outputs a sound signal corresponding to a sound picked up by the plurality of microphones;

a connector configured to mount the sound pickup portion inside the housing so that each of the plurality of microphones becomes oriented away from the musical instrument, in a state where the housing is mounted to the portion of the musical instrument via the mounting mechanism;

a sound signal processor configured to add a sound effect to the sound signal output from the first output terminal and output the sound signal added with the sound effect.

14. A sound processing device comprising:

a housing;

a mounting mechanism configured to mount the housing to portion of a musical instrument;

a sound pickup portion comprising a support plate, a plurality of microphones mounted to the support plate, which is configured to orient the plurality of microphones in different directions, and a board with a circuit configured to amplify a signal output from each of the plurality of microphones; and a first output terminal that outputs a sound signal corresponding to a sound picked up by the plurality of microphones;

a sensor connected to the housing and configured to detect vibration transmitted to the housing;

a second output terminal configured to output a vibration signal indicating the vibration detected by the sensor;

a connector configured to mount the sound pickup portion inside the housing so that each of the plurality of microphones becomes oriented away from the musical instrument, in a state where the housing is mounted to the portion of the musical instrument via the mounting mechanism; and a sound signal processor configured to:

add a first sound effect to the sound signal output from the first output terminal;

produce a vibration sound signal based on the vibration signal output from the second output terminal; and synthesize the sound signal with the added first sound effect, with one of the vibration sound signal or a sound signal produced by adding a second sound effect to the vibration sound signal, to generate and output a synthesized sound signal.

15. The pickup sound device according to claim 1, wherein the plurality of microphones are disposed so that the plurality of microphones do not overlap a striking surface of the object in relation to a direction perpendicular to the striking surface.

16. The sound processing device according to claim 14, wherein:

the support plate is mounted to the board, and the connector mounts the board to the housing.

* * * * *